United States Patent [19]

Wischoff

[11] Patent Number: 4,948,035

[45] Date of Patent: Aug. 14, 1990

[54] CONTAINER END CLOSURE ARRANGEMENT

[75] Inventor: Donald F. Wischoff, Fulton, N.Y.

[73] Assignee: Container Corporation of America, Clayton, Mo.

[21] Appl. No.: 466,001

[22] Filed: Jan. 16, 1990

[51] Int. Cl.[5] ..... B65D 5/10

[52] U.S. Cl. ..... 239/110; 229/156; 229/185

[58] Field of Search ..... 229/110, 155, 156, 185

[56] References Cited

U.S. PATENT DOCUMENTS

| | | | |
|---|---|---|---|
| 646,920 | 4/1900 | Schmidt | 229/110 |
| 1,787,736 | 1/1931 | Schrier | 229/110 |
| 2,123,147 | 7/1938 | Snyder | 229/110 |
| 2,858,968 | 11/1958 | Pellaton | 229/110 |
| 2,934,254 | 4/1960 | Ullger | 229/110 |
| 2,954,152 | 9/1960 | Buttery et al. | 229/110 |
| 3,269,640 | 8/1966 | Arneson | 229/110 |
| 3,525,466 | 8/1970 | Robinson | 229/110 |
| 3,549,081 | 12/1970 | Nelson | 229/156 |
| 4,199,098 | 4/1980 | Lopez | 229/110 |

*Primary Examiner*—Gary E. Elkins

*Attorney, Agent, or Firm*—Richard W. Carpenter

[57] ABSTRACT

An end closure arrangement for a hexagonal container that comprises separate closure flaps foldably joined to each container side wall panel at one end of the container. The flaps include a pair of inner closure flaps, a pair of first intermediate closure flaps, a second intermediate closure flap, and an outer closure flap, all of which are arranged in overlapping interlocking relation.

15 Claims, 3 Drawing Sheets

CONTAINER END CLOSURE ARRANGEMENT

BACKGROUND OF THE INVENTION

1. Field of the Invention:

This invention relates to end closure arrangements, and more particularly to a bottom end closure arrangement for a tubular paperboard container, which arrangement comprises a plurality of flaps foldably joined to the lower ends of the container side walls and disposed in overlapping interlocking relationship with each other.

2. Description of the Background Art:

A background art search directed to the subject matter of this application conducted in the U.S. Patent and Trademark Office disclosed the following U.S. Pat. Nos.:

| | | |
|---|---|---|
| 2,167,917 | 2,917,222 | 2,950,039 |
| 3,661,319 | 3,809,310 | 4,260,100 |

None of the patents found in the search discloses an end closure arrangement for a hexagonal container that comprises six separate closure flaps that are free from connection to each other, are foldably joined to corresponding ends of the container side wall panels, and are disposed in overlapped interlocking connection with each other in the manner of the present invention.

SUMMARY OF THE INVENTION

A primary purpose of the invention is to provide an improved end closure arrangement for a tubular container that is simple in design and easy to erect.

Another object of the invention is the provision of an improved interlocking flap arrangement for closing the lower end of a cylindrical container that can be erected manually.

A more specific object of the invention is the provision of a bottom end closure arrangement for a hexagonal container that includes six separate bottom closure flaps foldably joined to the respective side walls of the container and which can be easily and quickly positioned in overlapped interlocking relationship with each other to provide a positive closure for the bottom end of the container.

These and other objects of the invention will be apparent from the examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 6B:
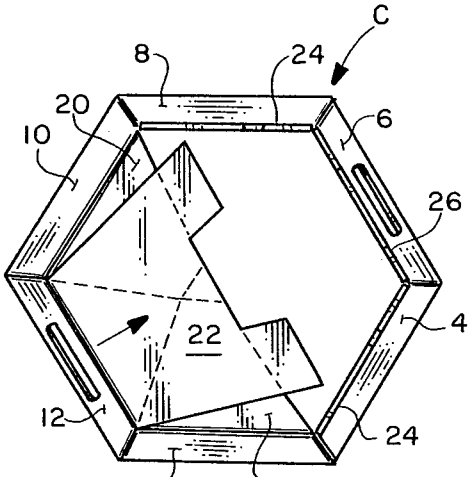
FIGS. 6A, 6B, 6C, and 6D are views similar to that of FIG. 4, but illustrate separate steps in the folding sequence required to assemble the bottom closure arrangement of the container: and container.
Figure 6A:
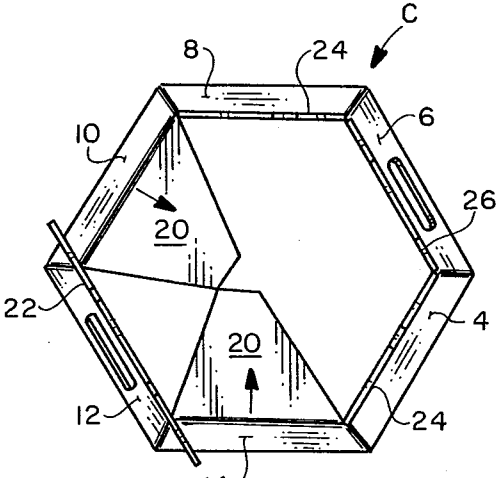
Figure 6D:
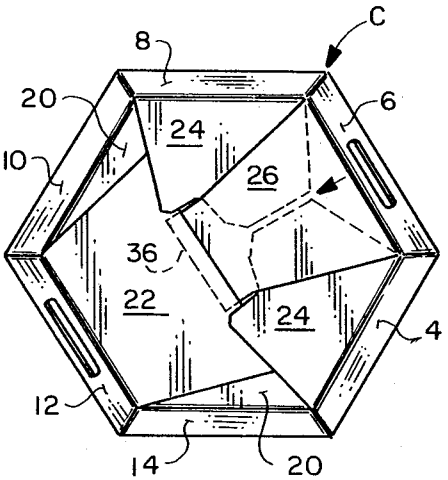
Figure 6C:
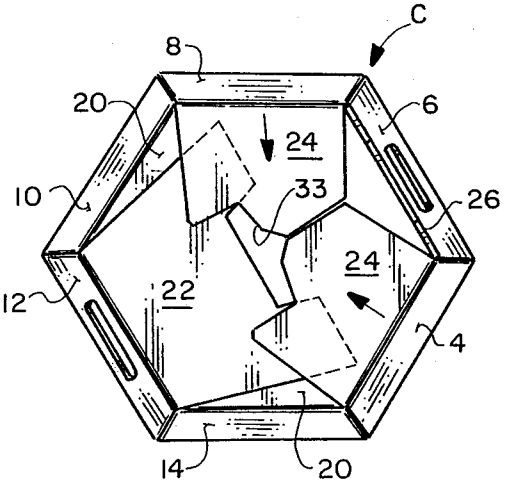
Figure 7:
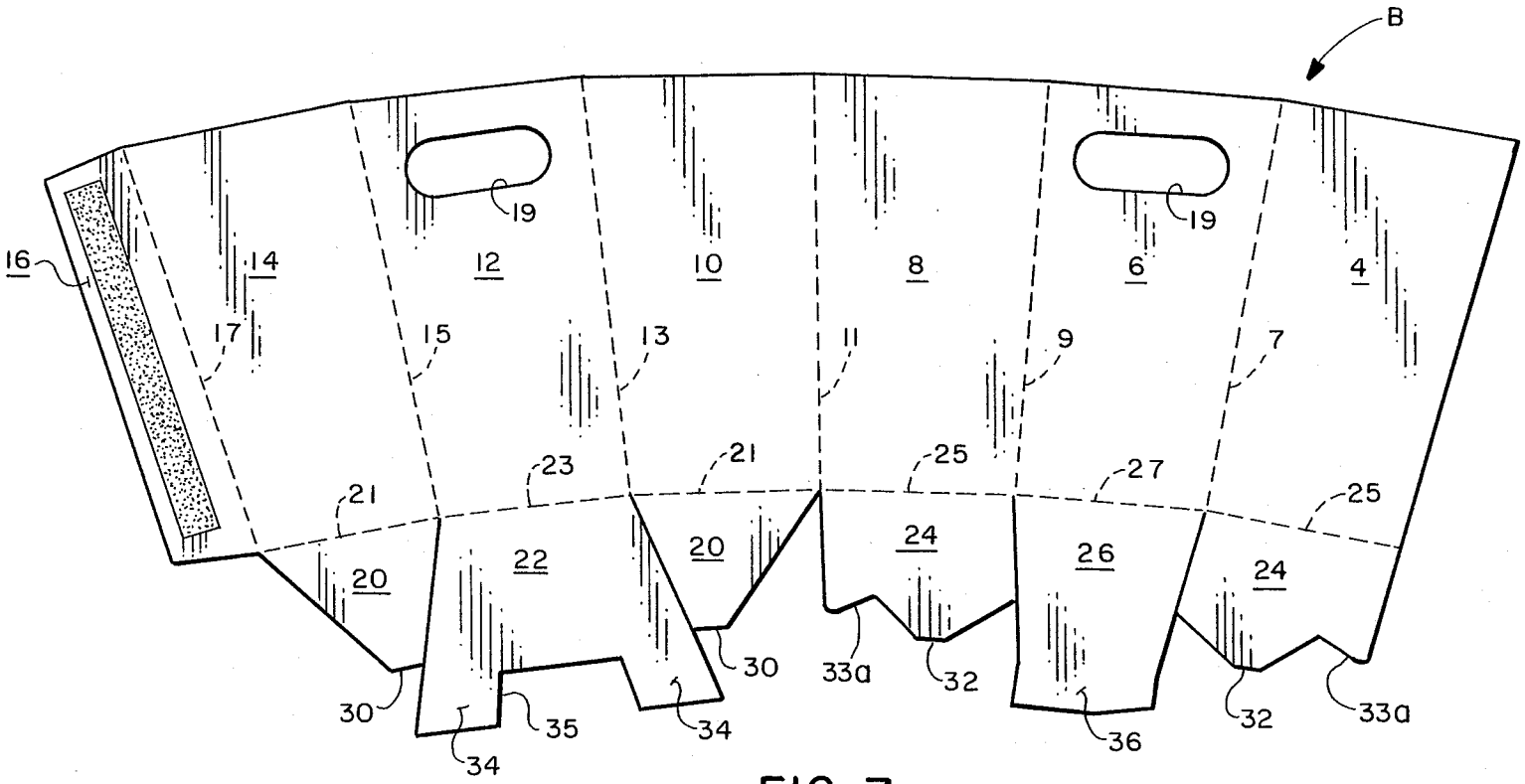
FIG. 7 is a blank of foldable sheet material from which the container illustrated in the other view may be formed.

Turning now to the drawings for a better understanding of the invention, it will be seen that the container indicated generally at C in FIGS. 1 and 2 through 6D may be formed from a unitary blank B of foldable sheet material, such as paperboard, illustrated in FIG. 7.

Container C illustrated in the drawings of the present application is shown as an open top hexagonal container with tapered side walls. Since the essential features of the invention reside in the bottom end closure arrangement, it will be understood that the end closure arrangement may be used with any type of tubular hexagonal container.

Figure 2:
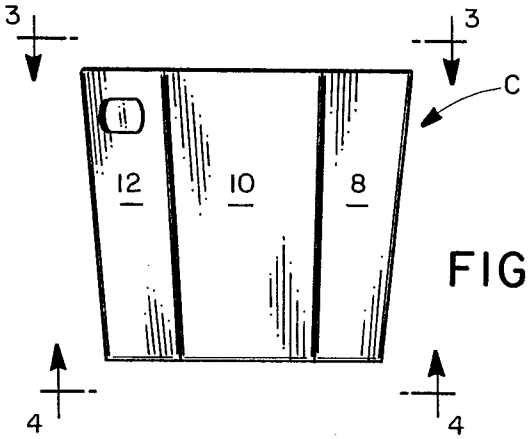
FIG. 2 is a side elevational view of the structure illustrated in FIG. 1.
Figure 3:
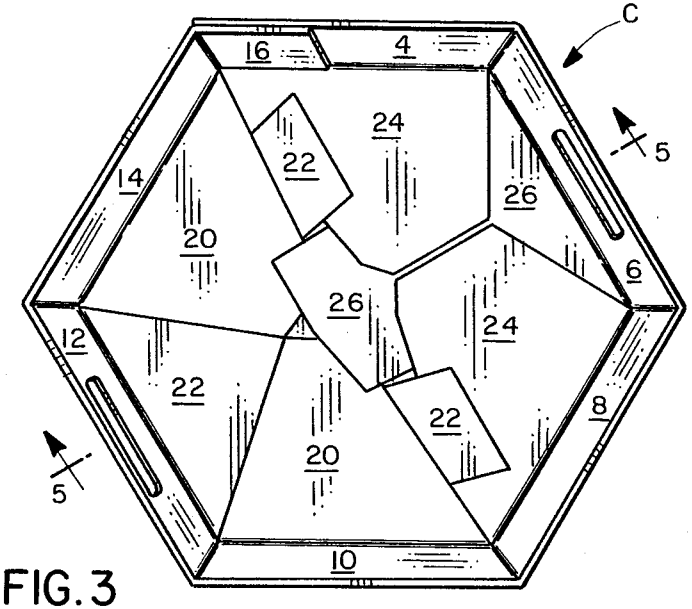
FIG. 3 is a top plan view of the structure illustrated in FIG. 1.
Figure 1:
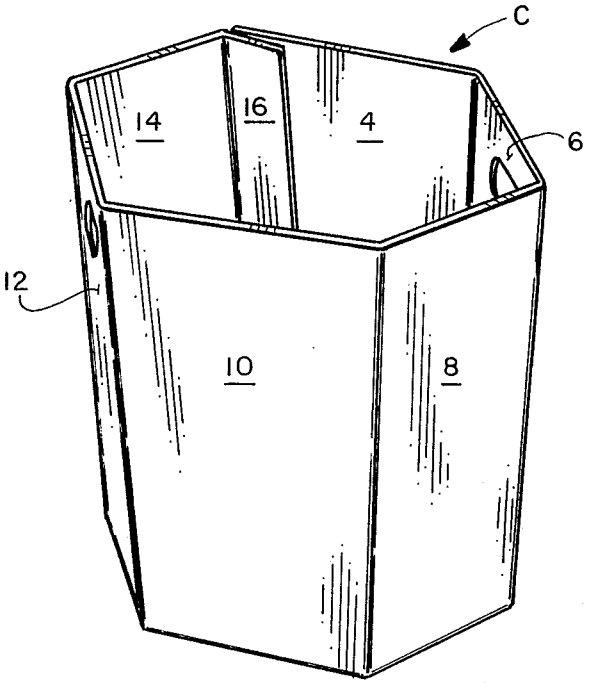
FIG. 1 is a perspective view of an erected container embodying features of the present invention.

Turning now to FIGS. 1 and 7, it will be seen that the blank B from which the container C is formed includes the following panels as viewed from right to left: a first third side wall panel 4, a first second side wall panel 6, a second third side wall panel 8, a first first side wall panel 10, a second second side wall panel 12, a second first side wall panel 14, and a glue flap 16, which are foldably joined to each other along longitudinal fold lines 7, 9, 11, 13, 15, and 17, respectively.

These fold lines extend transversely across the blank B and diverge slightly with respect to each other, so that each of the side wall panels is slightly trapezoidal, rather than purely rectangular, in shape.

Since the container shown in an open top basket of the type used for produce or other materials, two of the side wall panels may be provided with hand holes 19.

Now, turning to FIG. 7 of the drawings, it will be seen that the bottom end closure arrangement includes the following closure flaps: a pair of inner closure flaps 20, foldably joined along fold lines 21 to the lower ends of first side wall panels 10 and 14, respectively; a first intermediate flap 22, foldably joined along fold line 23 to the lower end of the one second side wall panel 12; a pair of second intermediate flaps 24, foldably joined along fold line 25 to the lower ends of third side wall panels 4 and 8, respectively; and an outer panel 26, foldably joined along a fold line 27 to the lower end of the other second side wall panel 6.

Each of the inner closure flaps 20 is generally triangular in shape, although slightly truncated, with a flat outer edge indicated at 30.

Each of the second intermediate flaps 24 has an irregular outer edge 32, which present a notch or recess **33*a*. The purpose of the recess 33*a* in each flap 24 is to provide a common recess 33, best seen in FIG. 6** of the drawings, when the container is erected.

Still referring to FIG. 7, it will be seen that first intermediate closure flap 22 is somewhat U-shaped in configuration and includes a pair of upwardly extending legs 34 that define therebetween a recess 35.

Turning now to FIGS. 6A through 6D of the drawings, it will be seen how the bottom closure arrangement is erected. Step one is to fold the inner closure flaps inwardly at right angles to their respective side wall panels shown in FIG. 6A.

Next, the first intermediate flap 22 is folded inwardly to overlie the inner flap 20 as illustrated in FIG. 6B.

Next, the second intermediate flaps 24 are folded inwardly to overlie the legs 34 of first intermediate closure flap 22 as illustrated in FIG. 6C.

Figure 4:
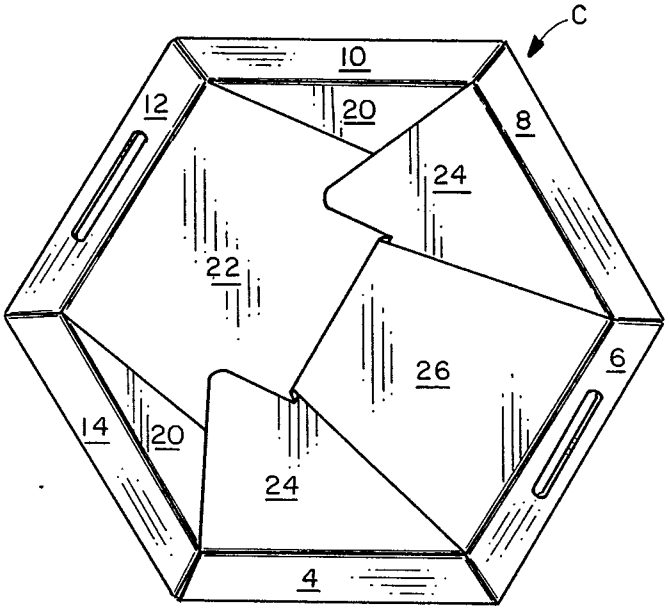
FIG. 4 is a bottom plan view of the structure illustrated in FIG. 1.
Figure 5:
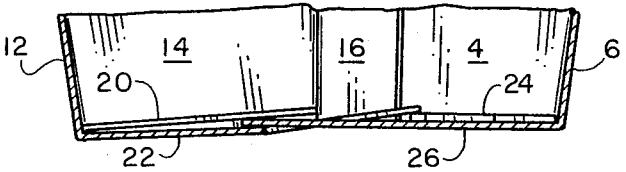
FIG. 5 is a fragmentary transverse vertical sectional view taken on line 5—5 of FIG. 3.

The final step is to fold the outer closure flap 26 over the adjoining portions of second intermediate closure flap 24, and then tuck the outer extremity or end portion 36 of outer flap 26 through the common opening 33 formed by the openings 33*a* in adjoining second intermediate closure flap 24 and then under the central end portion of first intermediate closure flap 22. This is shown in FIG. 4 and also in FIG. 3 and provides a firm interlocking closure for lower end of the container.

What is claimed is:

1. An end closure arrangement for a hexagonal container formed from a unitary blank of foldable sheet material and comprising:

(a) first, second, and third pairs of opposed side wall panels foldably joined to each other along longitudinal fold lines to provide a tubular structure open at a lower end;

(b) a pair of inner closure flaps foldably joined to lower ends of respective first side wall panels and disposed to extend inboardly therefrom toward each other;

(c) a first intermediate closure flap foldably joined to a lower end of one of second side wall panels and disposed to extend inboardly therefrom below said inner closure flaps;

(d) a pair of second intermediate closure flaps foldably joined to lower ends of respective third side wall panels and disposed to extend inboardly therefrom below said first intermediate closure flap;

(e) an outer closure flap foldably joined to a lower end of the other of said second side wall panels and disposed to extend inboardly therefrom;

(f) said outer closure flap having an outboard portion disposed below portions of said second intermediate closure flaps and having an inboard portion disposed above a portion of said first intermediate closure flap to provide interlocking engagement between said closure flaps to close the lower end of said container;

(g) each of said closure flaps being free from direct connection to adjacent closure flaps.

2. An arrangement according to claim 1, wherein said inner closure flaps are generally triangular in shape.

3. An arrangement according to claim 1, wherein said second intermediate closure flap is generally U-shaped and includes a pair of legs spaced from each other to define an opening therebetween.

4. An arrangement according to claim 1, wherein said first intermediate closure flaps have end edges presenting related openings adapted to cooperate with each other to form a common opening for receiving a portion of said outer closure flap therebetween.

5. An arrangement according to claim 1, wherein said longitudinal fold lines diverge to define therebetween side wall panels that are trapezoidal in shape.

6. An end closure arrangement for a hexagonal container formed from a unitary blank of foldable sheet material and comprising:

(a) first, second, and third pairs of opposed side wall panels foldably joined to each other along longitudinal fold lines to provide a tubular structure open at one end thereof;

(b) a pair of inner closure flaps foldably joined to respective first side wall panels at said one end and disposed to extend inboardly therefrom toward each other;

(c) a first intermediate closure flap foldably joined to one of said second side wall panels at said one end and disposed to extend inboardly therefrom over said inner closure flaps;

(d) a pair of second intermediate closure flaps foldably joined to respective third side wall panels at said one end and disposed to extend inboardly therefrom over said first intermediate closure flap;

(e) an outer closure flap foldably joined to the other of said second side wall panels at said one end and disposed to extend inboardly therefrom;

(f) said outer closure flap having an outboard portion disposed over portions of said second intermediate closure flaps and having an inboard portion disposed under a portion of said first intermediate closure flap to provide interlocking engagement between said closure flaps to close said one end of said container.

7. An arrangement according to claim 6, wherein said inner closure flaps are generally triangular in shape.

8. An arrangement according to claim 6, wherein said second intermediate closure flap is generally U-shaped and includes a pair of legs spaced from each other to define an opening therebetween.

9. An arrangement according to claim 6, wherein said first intermediate closure flaps have end edges presenting related openings adapted to cooperate with each other to form a common opening for receiving a portion of said outer closure flap therebetween.

10. An arrangement according to claim 6, wherein said longitudinal fold lines diverge to define therebetween side wall panels that are trapezoidal in shape.

11. A blank of foldable sheet material for use in forming a hexagonal container with an interlocking end closure flap arrangement, said blank being cut and scored to provide;

(a) six side wall panels serially arranged and foldably joined to each other along longitudinal fold lines extending transversely of said blank;

(b) six separate closure flaps foldably joined to corresponding ends of said side wall panels along transverse fold lines aligned with each other and extending longitudinally of the blank;

(c) said side wall panels including in the following order:

(i) a third side wall panel;

(ii) a second side wall panel;

(iii) another third side wall panel;

(iv) a first side wall panel;

(v) another second side wall panel;

(vi) another first side wall panel;

(d) a pair of inner closure flaps foldably joined to corresponding ends of respective first side wall panels;

(e) a pair of first intermediate closure flaps foldably joined to corresponding ends of said third side wall panels;

(f) a second intermediate closure flap foldably joined to an end of one of said second side wall panels;

(g) an outer closure flap foldably joined to an end of the other of said second side wall panels;

(h) each of said closure flaps being separated from each adjacent closure flap by a cut line that is aligned with a related longitudinal fold line.

12. A blank according to claim 11, wherein said inner closure flaps are generally triangular in shape.

13. A blank according to claim 11, wherein said second intermediate closure flap is generally U-shaped and includes a pair of legs spaced from each other to define an opening therebetween.

14. A blank according to claim 11, wherein said first intermediate closure flaps have end edges presenting related openings adapted to cooperate with each other to form a common opening for receiving a portion of said outer closure flap therebetween when said blank is erected into a container.

15. A blank according to claim 11, wherein said longitudinal fold lines diverge to define therebetween side wall panels that are trapezoidal in shape.

* * * * *